US010401100B2

(12) United States Patent
Bradford, Jr.

(10) Patent No.: US 10,401,100 B2
(45) Date of Patent: Sep. 3, 2019

(54) REMOTE CONTROLLED PORTABLE RESONANCE INDUCTION CLEANING SYSTEM

(71) Applicant: Hydrokinetics LLC, Houston, TX (US)

(72) Inventor: Brooks Bradford, Jr., Houston, TX (US)

(73) Assignee: HYDROKINETICS LLC, Houston, TX (US)

( * ) Notice: Subject to any disclaimer, the term of this patent is extended or adjusted under 35 U.S.C. 154(b) by 146 days.

(21) Appl. No.: 15/793,403

(22) Filed: Oct. 25, 2017

(65) Prior Publication Data

US 2019/0120577 A1 Apr. 25, 2019

(51) Int. Cl.

| | |
|---|---|
| ***F28G 15/00*** | (2006.01) |
| ***B08B 9/032*** | (2006.01) |
| ***F28G 7/00*** | (2006.01) |
| ***F28G 1/16*** | (2006.01) |
| ***F28G 9/00*** | (2006.01) |

(52) U.S. Cl.

CPC ..... *F28G 15/003* (2013.01); *B08B 9/0326* (2013.01); *F28G 1/163* (2013.01); *F28G 7/00* (2013.01); *F28G 9/00* (2013.01)

(58) Field of Classification Search

None

See application file for complete search history.

(56) References Cited

U.S. PATENT DOCUMENTS 4,991,608 A * 2/1991 Schweiger ..... F28G 9/00 134/102.2
5,674,323 A * 10/1997 Garcia ..... B08B 3/12 134/1
6,227,215 B1 * 5/2001 Akazawa ..... B08B 9/0323 134/103.1

* cited by examiner

*Primary Examiner* — Eric W Golightly
(74) *Attorney, Agent, or Firm* — Nolte Intellectual Property Law Group

(57) ABSTRACT

A remote controlled portable resonance induction cleaning system for cleaning a process tubular or heat exchanger can include a portable high pressure plunger pump, which can provide a liquid to a portable resonance induction cleaning apparatus, The remote controlled portable resonance induction cleaning apparatus can regulate flow of the liquid to provide pressurized pulses of the liquid with a resonance for removing fouling. A hose assembly or hydraulic ram connecting mechanism can provide the pressurized pulses of the liquid to the process tubular or heat exchanger. Air can be used to control flow of the pressurized pulses of the liquid. A hydraulic intensifier can be in fluid communication with the remote controlled portable resonance induction cleaning apparatus for receiving the air, and a hydraulic control valve can be bi-directionally engaged with the hydraulic intensifier and the hydraulic ram. The hydraulic ram can seal with the heat exchanger to provide the pressurized pulses of the liquid thereto.

15 Claims, 7 Drawing Sheets

REMOTE CONTROLLED PORTABLE RESONANCE INDUCTION CLEANING SYSTEM

FIELD

The present embodiment generally relates to a remote controlled portable resonance induction cleaning system.

BACKGROUND

A need exists for a remote controlled portable resonance induction cleaning system for cleaning process tubulars, heat exchangers, or both.

A need exists for a remote controlled portable resonance induction cleaning system that uses less liquid than traditional cleaning systems.

A need exists for a remote controlled portable resonance induction cleaning system that is compact and mobile; allowing for dispatch and use of the portable resonance induction cleaning system at various locations.

A need exists for a remote controlled portable resonance induction cleaning system that can clean process tubulars, heat exchangers, or both more quickly than traditional cleaning systems; thereby saving money, reducing downtime, and increasing productivity.

A need exists for a remote controlled portable resonance induction cleaning system that can clean process tubulars, heat exchangers, or both without a need for toxic chemicals.

A need exists for a remote controlled portable resonance induction cleaning system that can provide pressurized pulses of liquid that have a resonance configured to remove fouling from process tubulars, heat exchangers, or both.

A need exists for a remote controlled portable resonance induction cleaning system that can form a standing column of liquid within process tubulars, heat exchangers, or both, such that the standing column of the liquid can transmit the resonance of the pressurized pulses of liquid throughout the process tubulars, heat exchangers, or both.

A need exists for a remote controlled portable resonance induction cleaning system having pressure regulator valves between a portable high pressure plunger pump and a portable resonance induction cleaning apparatus, and between the portable resonance induction cleaning apparatus and the process tubulars, heat exchangers, or both; thereby providing for a safe and controlled pressure of the pressurized pulses of liquid.

The present embodiments meet these needs.

BRIEF DESCRIPTION OF THE DRAWINGS

The detailed description will be better understood in conjunction with the accompanying drawings as follows.

Figure 1:
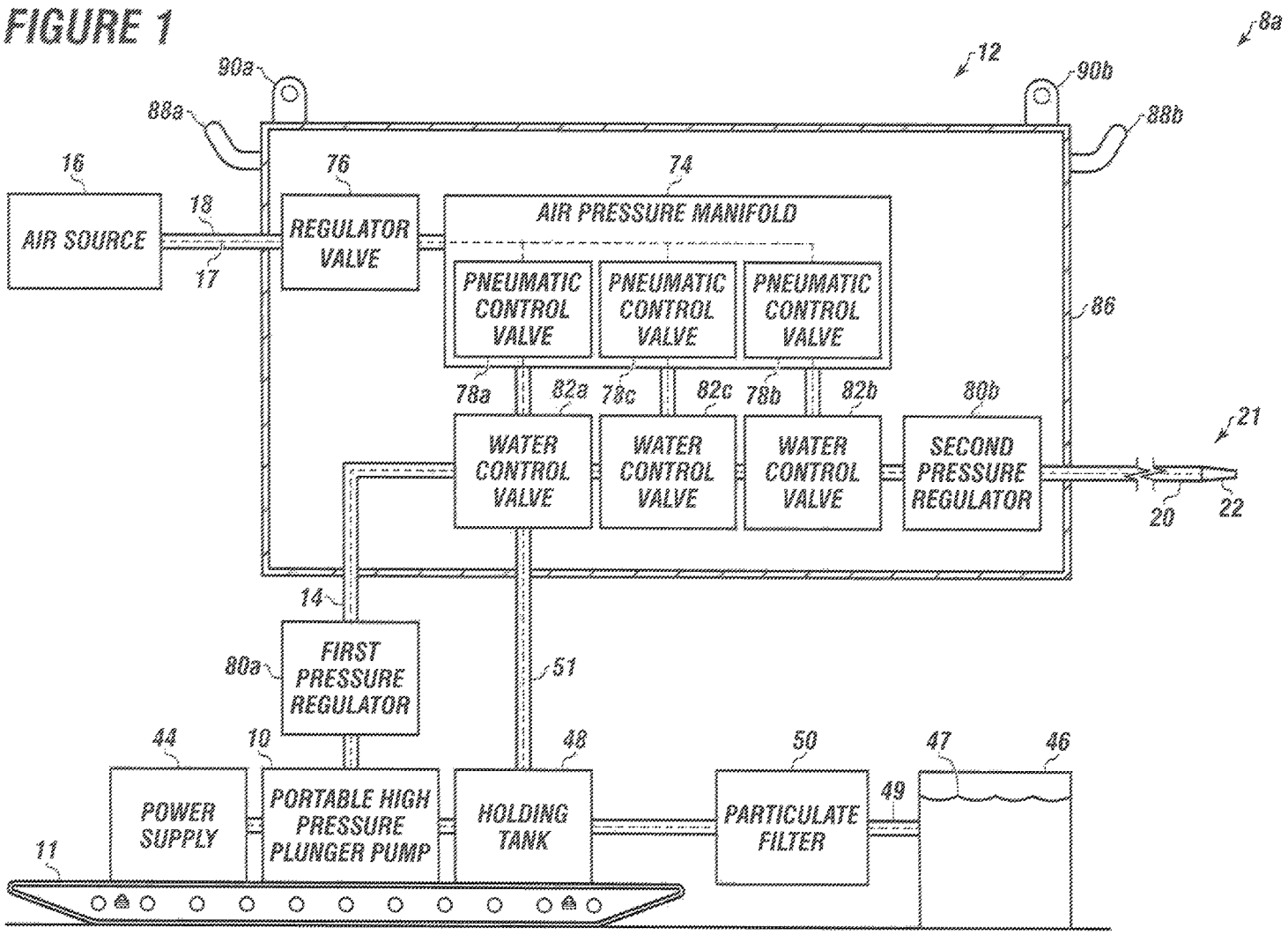
FIG. 1 depicts an embodiment of a remote controlled portable resonance induction cleaning system having a hose assembly engaged with a process tubular.

The present embodiments are detailed below with reference to the listed Figures.

DETAILED DESCRIPTION OF THE EMBODIMENTS

Before explaining the present remote controlled apparatus in detail, it is to be understood that the remote controlled apparatus is not limited to the particular embodiments and that it can be practiced or carried out in various ways.

Specific structural and functional details disclosed herein are not to be interpreted as limiting, but merely as a basis of the claims and as a representative basis for teaching persons having ordinary skill in the art to variously employ the present invention.

The present embodiments relate to a portable resonance induction cleaning system for cleaning process tubulars, heat exchangers, or both.

The process tubulars can be reaction chambers, tubes, such as those at a petrochemical facility, pipelines, wastewater conduits, umbilicals, intercoolers, or other tubulars. The process tubulars can be made of mild steel, INCONEL®, black iron, fiberglass, stainless steel, copper, bronze, aluminum, polyvinylchloride, copper-nickel alloys, HASTELLOY®, carbon, admiralty alloy, and other materials.

The heat exchanger can be an inner cooler, shell and tube, or the like.

The remote controlled portable resonance induction cleaning system can include a portable high pressure plunger pump, such as a portable high pressure plunger pump configured to pump at least 20 gallons of liquid per minute at 10,000 psi. For example, the portable high pressure plunger pump can be an NLB® 145 series, model 10145D or the like.

The portable high pressure plunger pump can be disposed on a movable support. The movable support can be a skid, a trailer, a barge, a floating platform, a truck, a boat, a rail car, or another movable support configured to be moved while supporting the portable high pressure plunger pump.

The portable high pressure plunger pump can be in fluid communication with a liquid supply for receiving a liquid therefrom. The liquid can be water without additives. The liquid supply can be a tank or other vessel containing the liquid.

The remote controlled portable resonance induction cleaning system can include a portable resonance induction cleaning apparatus in fluid communication with the portable high pressure plunger pump for receiving the liquid therefrom.

The portable resonance induction cleaning apparatus can be configured to regulate flow of the liquid to form pressurized pulses of the liquid that have a resonance for removing fouling from the process tubular, the heat exchanger, or both.

In operation, the portable resonance induction cleaning apparatus can continually provide the pressurized pulses of the liquid until the fouling is removed. The pressurized pulses can be expelled at a rate of about 400 kilometers per hour.

The fouling can be calcium carbonate, polyethylene, black iron, sulphur, pulp, styrene, sulphate, latex, nylon, crude oil, coke, naturally occurring radioactive materials waste, polypropylene, asphalt, polycarbonate, mill scale, cement, and other fouling.

In embodiments in which the remote controlled portable resonance induction cleaning system is used to clean process tubulars, a hose assembly can be connected with the portable resonance induction cleaning apparatus. The hose assembly can include a blind flange hose connection connected with a high pressure liquid hose. In operation, the blind flange hose connection can be at least partially sealed within the process tubular.

The hose assembly can be configured to receive the pressurized pulses of the liquid from the portable resonance induction cleaning apparatus. The hose assembly can be configured to engage the process tubular for providing the pressurized pulses of the liquid thereto.

In embodiments in which the remote controlled portable resonance induction cleaning system is used to clean heat exchangers, a ram connecting mechanism can be engaged with the portable resonance induction cleaning apparatus.

The ram connecting mechanism can include a hydraulic ram in fluid communication with the portable resonance induction cleaning apparatus for receiving the pressurized pulses of the liquid therefrom.

A hydraulic intensifier can be in fluid communication with the portable resonance induction cleaning apparatus for receiving air therefrom. The hydraulic intensifier can transfer pneumatic pressure into hydraulic pressure for operating the hydraulic ram to engage the hydraulic ram within tubes of the heat exchanger.

A hydraulic control valve can be bi-directionally engaged with the hydraulic intensifier and the hydraulic ram for regulating flow of hydraulic fluid to the hydraulic ram.

In operation, the hydraulic ram can seal with the heat exchanger and provide the pressurized pulses of the liquid thereto.

An air conduit can be connected with the portable resonance induction cleaning apparatus for receiving the air from an air source.

In operation, flow of the pressurized pulses of the liquid from the portable resonance induction cleaning apparatus to the hose assembly or the ram connecting mechanism can be controlled by using the air to control pneumatic control valves, and using the pneumatic control valves to control water control valves in the portable resonance induction cleaning apparatus.

The pressurized pulses of the liquid can be provided to the process tubulars, heat exchangers, or both until a standing column of liquid is formed within the process tubulars, the heat exchangers, or both. The pressurized pulses of the liquid can then be transmitted into standing column of the liquid, which can transmit the resonance of the pressurized pulses of liquid throughout the process tubulars, heat exchangers, or both; thereby removing the fouling.

Turning now to the Figures, FIG. 1 depicts an embodiment of the remote controlled portable resonance induction cleaning system 8*a*.

The remote controlled portable resonance induction cleaning system 8*a* can include a portable high pressure plunger pump 10 disposed on a movable support 11.

The portable high pressure plunger pump 10 can be in fluid communication with a liquid supply 46 for receiving a liquid 47 therefrom, such as through a liquid supply line 49.

In one or more embodiments, at least one particulate filter 50 can be disposed between the liquid supply 46 and the portable high pressure plunger pump 10. The at least one particulate filter 50 can be a five micron to twenty micron particulate filter.

The liquid 47 can flow from the liquid supply 46, through the at least one particulate filter 50, and into a holding tank 48 disposed on the movable support 11 between the liquid supply 46 and the portable high pressure plunger pump 10. The holding tank 48 can have a volumetric capacity ranging from about 10 gallons to about 500 gallons. The liquid 47 can then flow from the holding tank 48 to the portable high pressure plunger pump 10.

In one or more embodiments, a power supply 44 can be in communication with the portable high pressure plunger pump 10 and a portable controller connected to the portable induction cleaning system. The power supply 44 can be a 145 horse power CATERPILLAR® diesel engine or the like.

A portable resonance induction cleaning apparatus 12 can be in fluid communication with the portable high pressure plunger pump 10 for receiving the liquid 47 therefrom, such as through a first high pressure liquid hose 14. The first high pressure liquid hose 14 can have a length ranging from about 25 feet to about 500 feet, and the liquid 47 within the first high pressure liquid hose 14 can be at a pressure ranging from about 100 psi to about 10000 psi.

In one or more embodiments, a first pressure regulator 80*a*, such as a JETSTREAM® model 53920, can be in fluid communication between the portable high pressure plunger pump 10 and the portable resonance induction cleaning apparatus 12. The first pressure regulator 80*a* can regulate the pressure of the liquid 47 flowing from the portable high pressure plunger pump 10 to provide for safety and maintain piping integrity in the portable resonance induction cleaning system 8*a*. The first and second pressure regulators can be in communication with the portable controller shown in FIG. 7.

The portable resonance induction cleaning apparatus 12 can include an enclosure 86, which can be configured to contain an over-pressurization rupture in the portable resonance induction cleaning apparatus 12. For example, the enclosure 86 can be configured to contain over-pressurization ruptures up to a pressure of about 15,000 psi. As such, the enclosure 86 can provide a safe work environment by preventing debris from over-pressurization ruptures from impacting nearby workers, equipment, or vessels containing toxic chemicals. The enclosure 86 can be made of stainless steel, and can have walls with a thickness ranging from about 0.035 inches to about 0.1 inches.

The enclosure 86 can have one or more handles 88*a* and 88*b* allowing for manual movement of the enclosure 86, and one or more lifting eyes 90*a* and 90*b* allowing for movement of the enclosure 86 via a crane or forklift.

The portable resonance induction cleaning apparatus 12 can be in fluid communication with an air source 16, such as through an air conduit 18, for receiving air 17 therefrom.

In one or more embodiments, the air source 16 can be at a pressure ranging from about 80 psi to about 110 psi.

The portable resonance induction cleaning apparatus 12 can include an air pressure manifold 74, which can be configured to receive the air 17 through the air conduit 18 from the air source 16.

A regulator valve 76 can be in fluid communication between the air source 16 and the air pressure manifold 74 for regulating a pressure of the air 17 and providing the air 17 to one or more pneumatic control valves 78*a*, 78*b*, and 78*c* of the portable resonance induction cleaning apparatus 12. The one or more pneumatic control valves 78*a*-78*c* can be AAA PRODUCTS model H02 valves or the like. In one or more embodiments, the regulator valve 76 can be disposed outside of the enclosure 86.

The portable resonance induction cleaning apparatus 12 can include one or more water control valves 82*a*, 82*b*, and 82*c*.

The water control valve 82*a* can be in fluid communication with the pneumatic control valve 78*a*. The pneumatic control valve 78*a* can be configured to actuate the water control valve 82*a* using the air 17; thereby opening the water control valve 82*a*.

The water control valve 82*a* can be configured to receive the liquid 47 from the portable high pressure plunger pump 10.

The water control valve 82*b* can be in fluid communication with the pneumatic control valve 78*b*. The pneumatic control valve 78*b* can be configured to actuate the water control valve 82*b* using the air 17; thereby opening the water control valve 82*b*. The water control valve 82*b* can be configured to receive the liquid 47 from the portable high pressure plunger pump 10.

In operation, when the water control valve 82*a* is opened the liquid 47 can flow through the water control valve 82*a* to the water control valve 82*b*, and when the water control valve 82*b* is opened pressurized pulses of the liquid 47 can flow to a hose assembly 21 in fluid communication with the portable resonance induction cleaning apparatus 12.

The water control valve 82*c* can be configured to be closed via the air 17 from the pneumatic control valve 78*c* for stopping flow of the pressurized pulses of the liquid 47, such as for use in emergency situations. As such, the water control valve 82*c* can provide for safety to nearby workers, equipment, and vessels containing toxic chemicals. The water control valve 82*c* can be in fluid communication between the water control valve 82*a* and the water control valve 82*b*.

In operation, when the water control valve 82*a* is closed, the liquid 47 can flow to the holding tank 48, such as through a liquid return line 51. As such, flow of the pressurized pulses of the liquid 47 from the portable resonance induction cleaning apparatus 12 to the hose assembly 21 can be controlled via the air 17.

One or more embodiments can include a second pressure regulator 80*b*, such as a JETSTREAM® model 53920, in fluid communication between the water control valve 82*b* and the hose assembly 21 for providing safety and maintaining pipe integrity of the portable resonance induction cleaning system 8*a*.

The portable resonance induction cleaning apparatus 12, via the one or more pneumatic control valves 78*a*-78*c* and the one or more water control valves 82*a*-82*c*, can be configured to regulate flow of the liquid 47 to continually provide the pressurized pulses of the liquid 47 to the hose assembly 21.

The hose assembly 21 can be connected with the portable resonance induction cleaning apparatus 12 and configured to receive the pressurized pulses of the liquid 47 from the portable resonance induction cleaning apparatus 12. The hose assembly 21 can be configured to engage a process tubular for providing the pressurized pulses of the liquid 47 thereto.

In one or more embodiments, the hose assembly 21 can include a second high pressure liquid hose 20 connected to portable resonance induction cleaning apparatus 12 and a hose connector 22 connected to the second high pressure liquid hose 20.

The second high pressure liquid hose 20 can have a length ranging from about 25 feet to about 500 feet, and the liquid 47 within the second high pressure liquid hose 20 can be at a pressure ranging from about 100 psi to about 10000 psi.

In one or more embodiments, the hose connector 22 can be a blind flange hose connection.

Figure 2A:
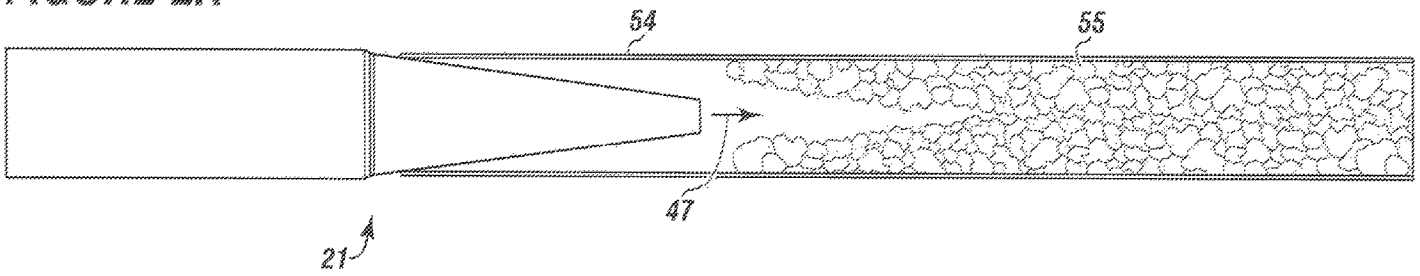
FIG. 2A depicts the hose assembly engaged with the process tubular in a substantially fouled state.
Figure 2B:
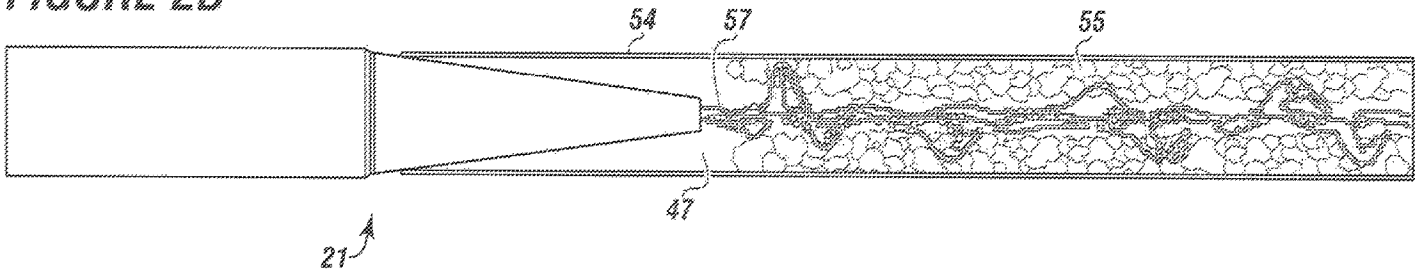
FIG. 2B depicts the hose assembly engaged with the process tubular in a partially cleaned state.
Figure 2C:
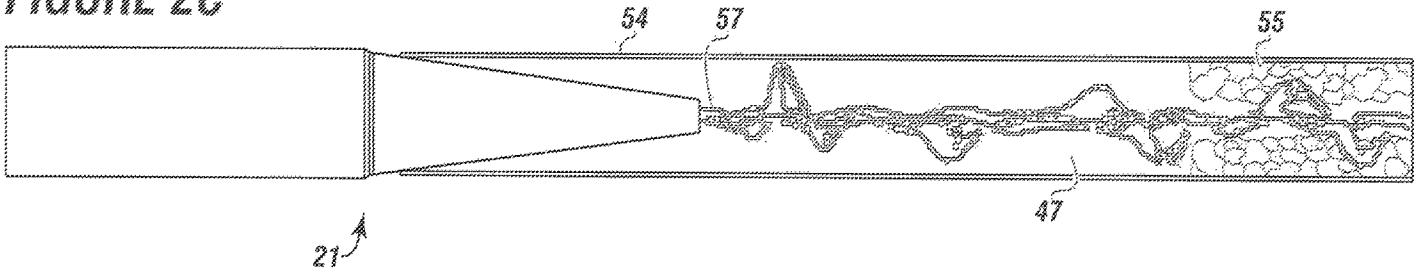
FIG. 2C depicts the hose assembly engaged with the process tubular with the fouling substantially removed from the process tubular.

FIG. 2A depicts the hose assembly 21 engaged with a process tubular 54 in a substantially fouled state, FIG. 2B depicts the hose assembly 21 engaged with the process tubular 54 in a partially cleaned state, and FIG. 2C depicts the hose assembly 21 engaged with the process tubular 54 with the fouling 55 substantially removed from the process tubular 54.

The hose assembly 21 can provide the liquid 47 into the process tubular 54 in pressurized pulses. The pressurized pulses of the liquid 47 can have a resonance 57 for removing the fouling 55 from the process tubular 54; thereby cleaning the process tubular 54 of the fouling 55. In embodiments, the process tubular 54 can be a substantially fouled process tubular 54.

In operation, the pressurized pulses of the liquid 47 can be expelled into the process tubular 54, as depicted in FIG. 2A.

As the pressurized pulses of the liquid 47 are continually provided into the process tubular 54, a standing column of the liquid 47 can be formed within the process tubular 54, as depicted in FIG. 2B.

The standing column of the liquid 47 can transmit the resonance 57 throughout the process tubular 54, and the resonance 57 can transfer to both the process tubular 54 and the fouling 55.

The differing compositions of the process tubular 54 and the fouling 55 can cause the process tubular 54 and the fouling 55 to resonate at different frequencies in response to the resonance 57; thereby breaking bonds between the process tubular 54 and the fouling 55.

After the fouling 55 has been dislodged from engagement with the process tubular 54, the fouling 55 can be flushed out of the process tubular 54 by additional pressurized pulses of the liquid 47, as depicted in FIG. 2C.

Figure 3:
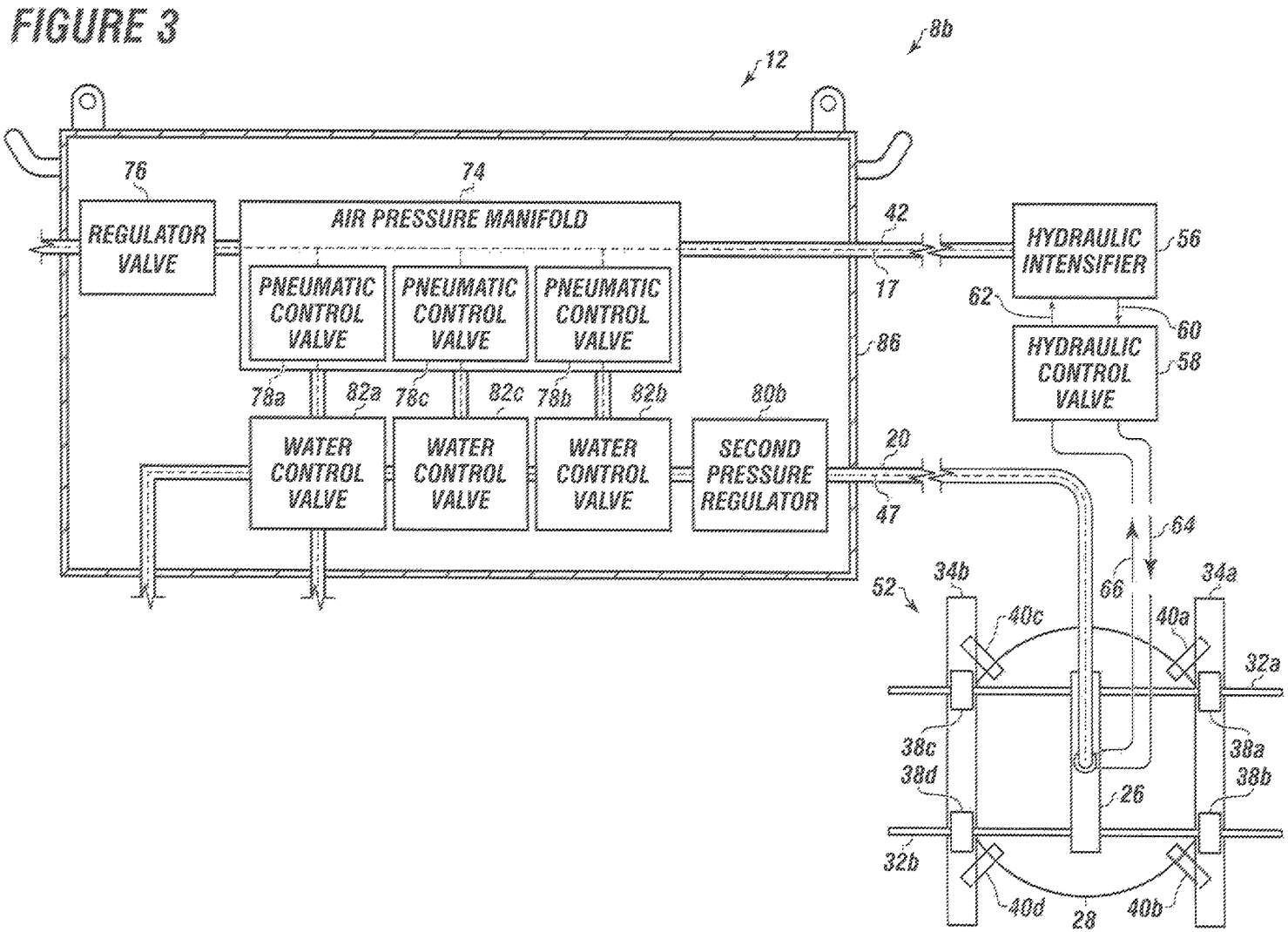
FIG. 3 depicts an embodiment of the remote controlled portable resonance induction cleaning system having a ram connecting mechanism engaged with a heat exchanger.

FIG. 3 depicts an embodiment of the remote controlled portable resonance induction cleaning system 8*b* for cleaning a heat exchanger 28.

The remote controlled portable resonance induction cleaning system 8*b* can be substantially similar to the remote controlled portable resonance induction cleaning system depicted in FIG. 1 with the exception that the hose assembly can be replaced with a ram connecting mechanism 52 engaged with the heat exchanger 28. The heat exchanger 28 can be a substantially fouled heat exchanger 28.

The portable resonance induction cleaning apparatus 12 with the enclosure 86 can be configured to regulate flow of the liquid 47 to continually provide the pressurized pulses of the liquid 47 that have a resonance for removing fouling from within the heat exchanger 28.

The water control valve 82*a* can be opened via the pneumatic control valve 78*a* of the air pressure manifold 74 using the air 17 received from the air source via the regulator valve 76.

The water control valve 82*b* can be opened via the pneumatic control valve 78*b*, and the water control valve 82*c* can be opened via the pneumatic control valve 78*c*.

When the water control valve 82*a*, the water control valve 82*b*, and the water control valve 82*c* are each opened, the liquid 47 can flow through the second pressure regulator 80*b* to the ram connecting mechanism 52 through the second high pressure liquid hose 20.

The ram connecting mechanism 52 can include a hydraulic ram 26, which can be in fluid communication with the portable resonance induction cleaning apparatus 12 through the second high pressure liquid hose 20 for receiving the liquid 47 therefrom.

The hydraulic ram 26 can receive the pressurized pulses of the liquid 47 from the portable resonance induction cleaning apparatus 12 for expulsion into the heat exchanger 28.

A hydraulic intensifier 56 can be in fluid communication with the portable resonance induction cleaning apparatus 12 for receiving the air 17 therefrom, such as through a low pressure air line 42 in fluid communication with the air pressure manifold 74. The hydraulic intensifier 56 can convert pneumatic pressure from the air 17 into hydraulic pressure.

A hydraulic control valve 58 can be in bi-directional fluid communication with the hydraulic intensifier 56, such as through hydraulic fluid lines, and the hydraulic control valve 58 can be in bi-directional fluid communication with the hydraulic ram 26, such as through hydraulic fluid lines.

In operation, the hydraulic intensifier 56 can provide an applied hydraulic flow 60 to the hydraulic control valve 58, the hydraulic control valve 58 can provide a controlled hydraulic flow 64 to the hydraulic ram 26, the hydraulic ram 26 can provide a first return hydraulic flow 66 to the hydraulic control valve 58, and the hydraulic control valve 58 can provide a second return hydraulic flow 62 to the hydraulic intensifier 56.

As such, the hydraulic intensifier 56 can exert a hydraulic pressure on the hydraulic ram 26, and the hydraulic ram 26 can at least partially seal with tubes of the heat exchanger 28 using the hydraulic pressure.

The ram connecting mechanism 52 can include a plurality of support beams 34*a* and 34*b* for engaging with the heat exchanger 28.

The ram connecting mechanism 52 can include a plurality of clamps 40*a*, 40*b*, 40*c*, and 40*d* connected to the heat exchanger 28 and engaged with one of the support beams 34*a* and 34*b* to act as a stop to the support beams 34*a* and 34*b*. The clamps 40*a*-40*d* can be metal plates bolted to the heat exchanger 28.

The ram connecting mechanism 52 can include a plurality of carrier rods 32*a* and 32*b* that can support the support beams 34*a* and 34*b* at 90 degree angles. Each carrier rod 32*a* and 32*b* can engage with the hydraulic ram 26.

The ram connecting mechanism 52 can include a plurality of carriers 38*a*, 38*b*, 38*c*, and 38*d*. Each carrier 38*a*-38*d* can be connected with one of the carrier rods 32*a* and 32*b* and one of the support beams 34*a* and 34*b*.

The carriers 38*a*-38*d* can be movably engaged with the support beams 34*a* and 34*b*, allowing the hydraulic ram 26 to move relative to the heat exchanger 28 for engagement with each tube of the heat exchanger 28.

For example, the hydraulic ram 26 can be aligned with a first tube of the heat exchanger 28, and the hydraulic pressure can be applied to the hydraulic ram 26 via the controlled hydraulic flow 64 to at least partially seal the hydraulic ram 26 in the first tube. The first tube can be cleaned using the pressurized pulses of the liquid 47.

After the first tube is cleaned, application of the hydraulic pressure via the controlled hydraulic flow 64 can be ceased to disengage the hydraulic rain 26 from the first tube, and the hydraulic ram 26 can be moved to he aligned with a second tube of the heat exchanger 28 for cleaning thereof.

Figure 4:
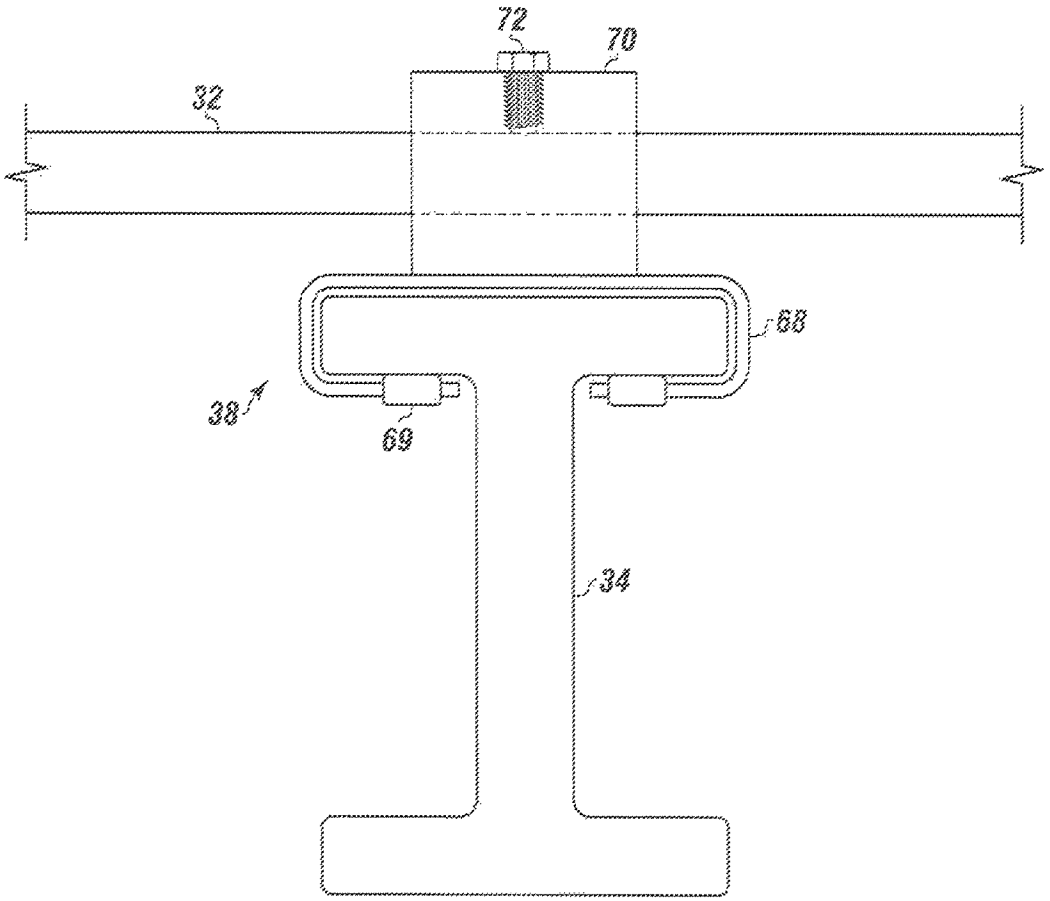
FIG. 4 depicts a cut view detailing a connection between the ram connecting mechanism and the heat exchanger.

FIG. 4 depicts a cut view detailing a connection between the ram connecting mechanism and the heat exchanger.

The carrier 38 can include a carrier engagement portion 68 having wheels 69. In one or more embodiments, the wheels 69 can be made of metal.

The carrier engagement portion 68 can engage about a portion of the support beam 34.

The wheels 69 can engage with a portion of the support beam 34, and can be configured to allow the carrier 38 to move along the support beams 34.

The carrier 38 can include a carrier rod engagement portion 70 for engaging the carrier rod 32, such as through a hole in the carrier rod engagement portion 70.

A set screw 72 can be engaged through the carrier rod engagement portion 70 for securing the carrier rod 32 therein.

Figure 5:
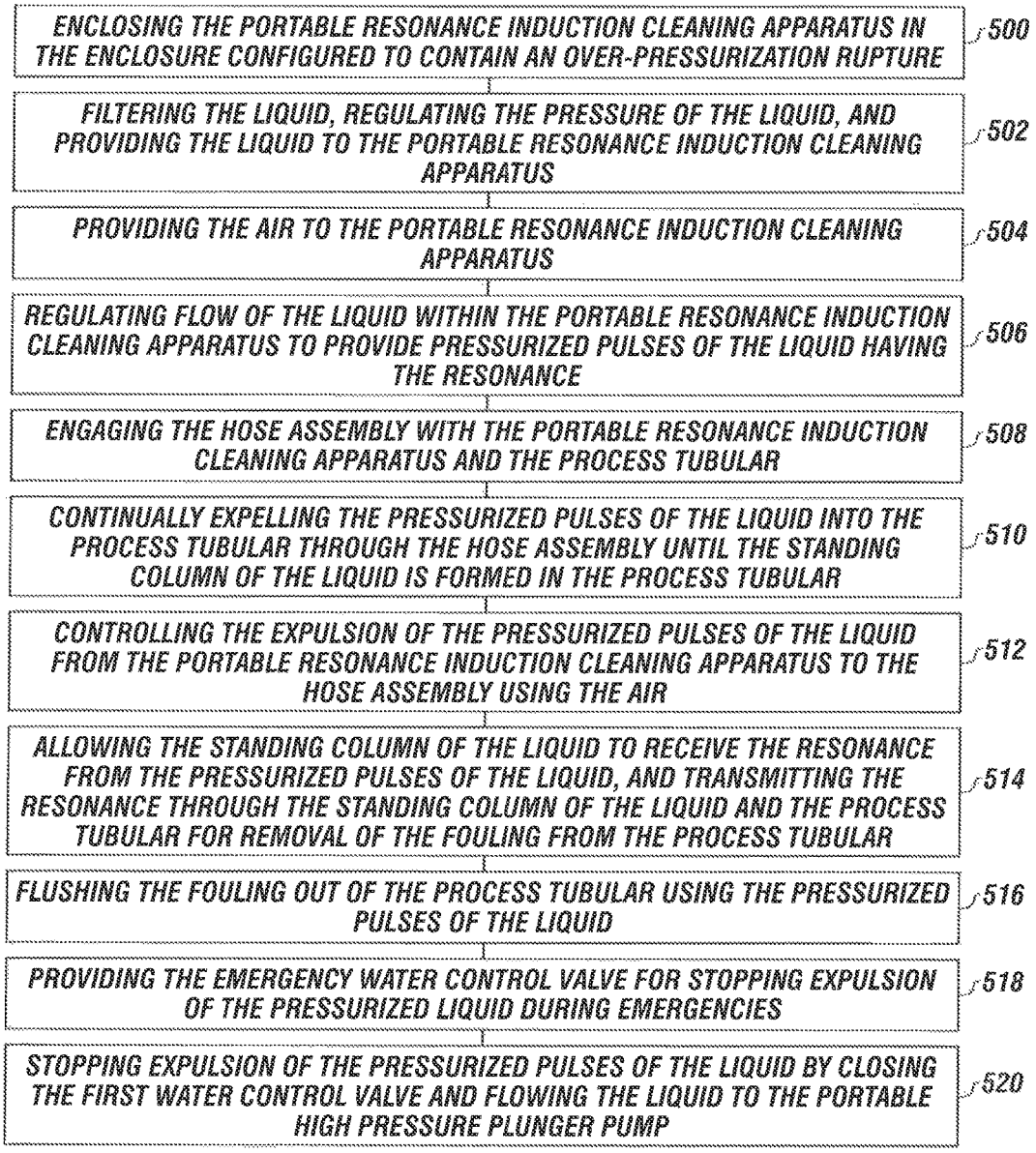
FIG. 5 depicts an embodiment of a method for cleaning a process tubular that can be implemented using one or more embodiments of the remote controlled portable resonance induction cleaning system.

FIG. 5 depicts an embodiment of a method for cleaning a process tubular.

The method can include enclosing the portable resonance induction cleaning apparatus in the enclosure configured to contain an over-pressurization rupture, as illustrated by box 500.

The method can include filtering the liquid, regulating the pressure of the liquid, and providing the liquid to the portable resonance induction cleaning apparatus, as illustrated by box 502.

The method can include providing the air to the portable resonance induction cleaning apparatus, as illustrated by box 504.

The method can include regulating flow of the liquid within the portable resonance induction cleaning apparatus to provide pressurized pulses of the liquid having the resonance, as illustrated by box 506.

For example, the pressure of the air can be regulated before providing the air to the one or more pneumatic control valves, and the air can be then be used by the one or more pneumatic control valves to open the first water control valve and the second water control valve to flow the pressurized pulses of the liquid to the hose assembly. Furthermore, the pressure of the expulsion of the pressurized pulses of the liquid through the hose assembly can also be regulated.

The method can include engaging the hose assembly with the portable resonance induction cleaning apparatus and the process tubular, as illustrated by box 508.

The method can include continually expelling the pressurized pulses of the liquid into the process tubular through the hose assembly until the standing column of the liquid is formed in the process tubular, as illustrated by box 510.

The method can include controlling the expulsion of the pressurized pulses of the liquid from the portable resonance induction cleaning apparatus to the hose assembly using the air, as illustrated by box 512.

The method can include allowing the standing column of the liquid to receive the resonance from the pressurized pulses of the liquid, and transmitting the resonance through the standing column of the liquid and the process tubular for removal of the fouling from the process tubular, as illustrated by box 514. For example, the resonance of the pressurized pulses of the liquid can be used to resonate the fouling and the process tubular at different frequencies to break bonds between the process tubular and the fouling; thereby removing the fouling from the process tubular.

The method can include flushing the fouling out of the process tubular using the pressurized pulses of the liquid, as illustrated by box 516.

The method can include providing the emergency water control valve for stopping expulsion of the pressurized liquid during emergencies, as illustrated by box 518.

The method can include stopping expulsion of the pressurized pulses of the liquid by closing the first water control valve and flowing the liquid to the portable high pressure plunger pump, as illustrated by box 520.

Figure 6:
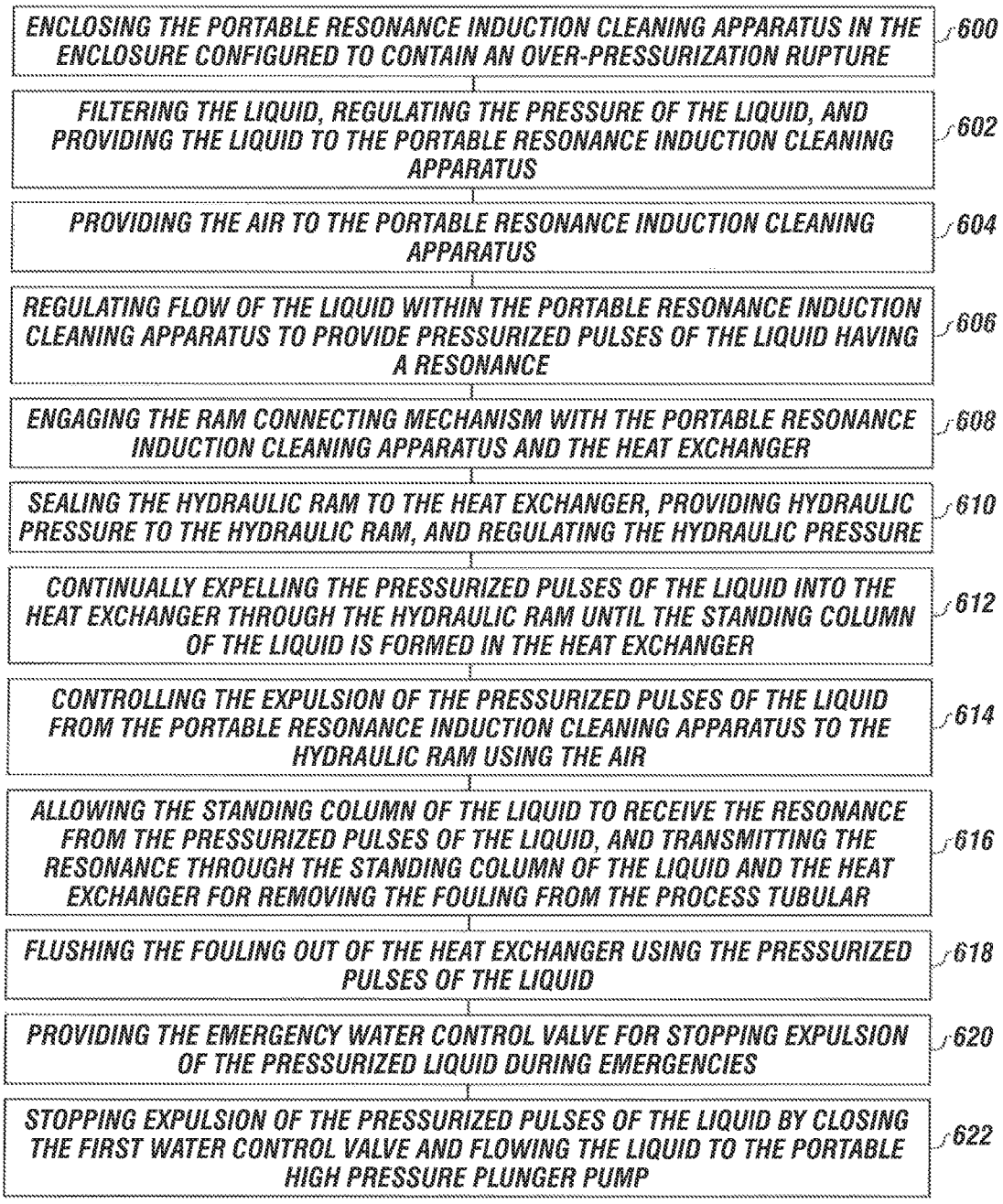
FIG. 6 depicts an embodiment of a method for cleaning a heat exchanger tubular that can be implemented using one or more embodiments of the remote controlled portable resonance induction cleaning system.

FIG. 6 depicts an embodiment of a method for cleaning a heat exchanger.

The method can include enclosing the portable resonance induction cleaning apparatus in the enclosure configured to contain an over-pressurization rupture, as illustrated by box 600.

The method can include filtering the liquid, regulating the pressure of the liquid, and providing the liquid to the portable resonance induction cleaning apparatus, as illustrated by box 602.

The method can include providing the air to the portable resonance induction cleaning apparatus, as illustrated by box 604.

The method can include regulating flow of the liquid within the portable resonance induction cleaning apparatus to provide pressurized pulses of the liquid having a resonance, as illustrated by box 606.

The method can include engaging the ram connecting mechanism with the portable resonance induction cleaning apparatus and the heat exchanger, as illustrated by box 608.

The method can include sealing the hydraulic ram to the heat exchanger, providing hydraulic pressure to the hydraulic ram, and regulating the hydraulic pressure, as illustrated by box 610. For example, the hydraulic pressure can be provided to the hydraulic ram using the hydraulic intensifier connected with the portable resonance induction cleaning apparatus. The hydraulic intensifier can convert the pneumatic pressure of the air into the hydraulic pressure for controlling the hydraulic ram. The hydraulic pressure can be regulated using the hydraulic control valve hi-directionally engaged with the hydraulic intensifier and the hydraulic ram.

The method can include continually expelling the pressurized pulses of the liquid into the heat exchanger through the hydraulic ram until the standing column of the liquid is formed in the heat exchanger, as illustrated by box 612.

The method can include controlling the expulsion of the pressurized pulses of the liquid from the portable resonance induction cleaning apparatus to the hydraulic ram using the air, as illustrated by box 614.

The method can include allowing the standing column of the liquid to receive the resonance from the pressurized pulses of the liquid, and transmitting the resonance through the standing column of the liquid and the heat exchanger for removing the fouling from the process tubular, as illustrated by box 616. For example, the resonance of the pressurized pulses of the liquid can be used to resonate the fouling and the heat exchanger at different frequencies to break bonds between the heat exchanger and the fouling; thereby removing the fouling from the heat exchanger.

The method can include flushing the fouling out of the heat exchanger using the pressurized pulses of the liquid, as illustrated by box 618.

The method can include providing the emergency water control valve for stopping expulsion of the pressurized liquid during emergencies, as illustrated by box 620.

The method can include stopping expulsion of the pressurized pulses of the liquid by closing the first water control valve and flowing the liquid to the portable high pressure plunger pump, as illustrated by box 622.

Figure 7:
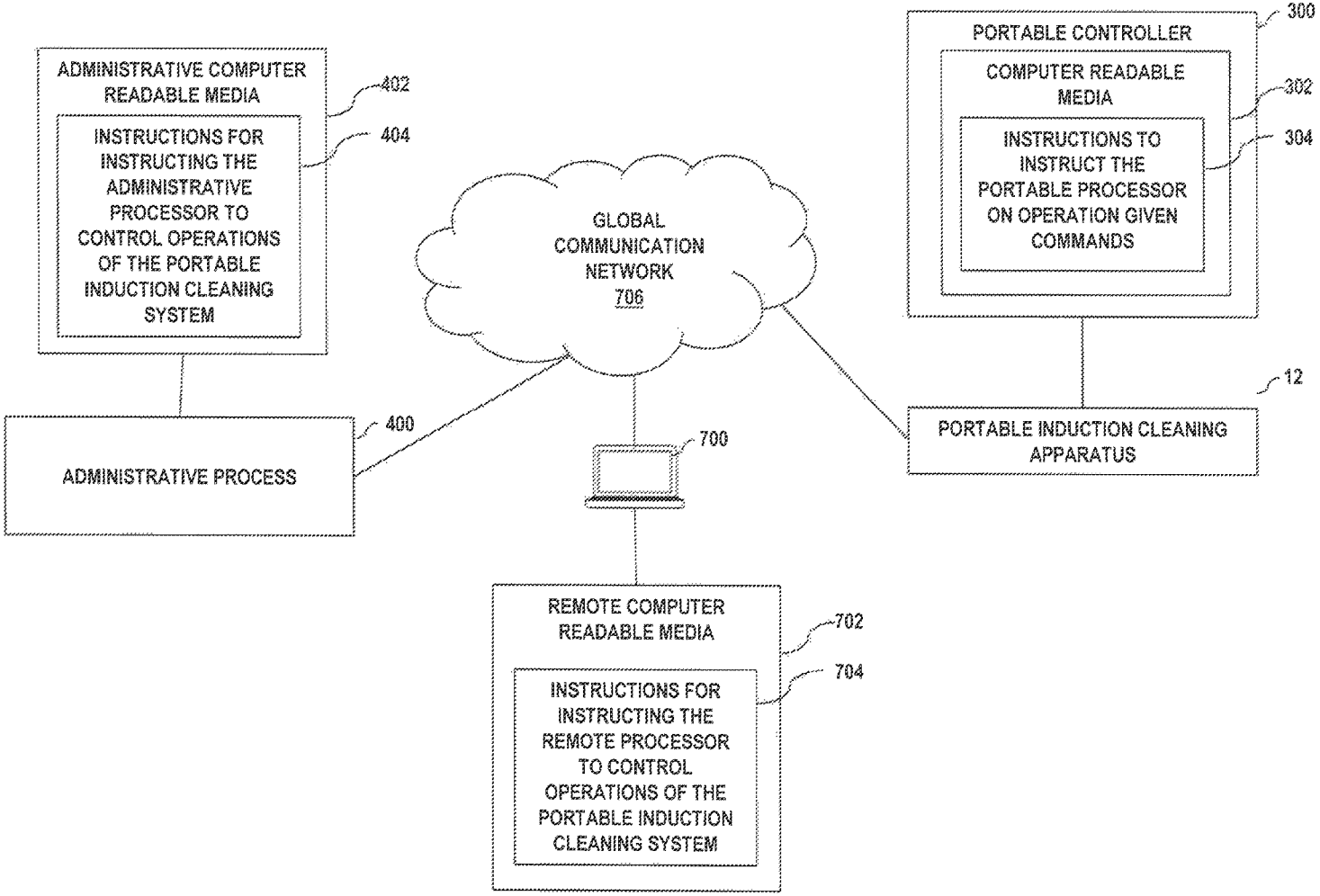
FIG. 7 depicts the remote controlled portable resonance induction cleaning system connected to a global communication network with the remote processor and administrative processor.

FIG. 7 depicts a diagram of the a portable controller 300 connected to the portable induction cleaning apparatus 12 with computer readable media 302 containing instructions 304 to instruct the portable processor on operation given commands from at least one of: an administrative processor 400 with administrative computer readable media 403 with instructions 404 for instructing the administrative processor to control operations of the portable bid action cleaning, system, and a remote client device 700 with a remote processor and remote computer readable media 702 with instructions 704 for instructing the remote processor to control operations of the portable induction cleaning system.

The remote client device, administrative processor and portable controller all communicate via a global communication network 706 which can be the internet.

It should be noted that the first pressure regulator for regulating the pressure of the liquid flowing from the portable high pressure plunger pump is connected to the portable processor.

In embodiments, a second pressure regulator for regulating the pressure of the liquid flowing to the hose assembly is connected to the portable processor.

The air conduit connected with the portable resonance induction cleaning apparatus for receiving air from an air source can have in embodiments, and air source in communication with the portable processor.

While these embodiments have been described with emphasis on the embodiments, it should be understood that within the scope of the appended claims, the embodiments might be practiced other than as specifically described herein.

What is claimed is:

1. A remote controlled portable resonance induction cleaning system for engaging a process tubular, the remote controlled portable resonance induction cleaning system comprising:

a. a portable high pressure plunger pump disposed on a movable support, wherein the portable high pressure plunger pump is in fluid communication with a liquid supply for receiving a liquid therefrom;

b. a portable resonance induction cleaning apparatus connected to the portable high pressure plunger pump for receiving the liquid therefrom, wherein the portable resonance induction cleaning apparatus is configured to regulate flow of the liquid to continually provide pressurized pulses of the liquid, and wherein the pressurized pulses of the liquid have a resonance for removing fouling from the process tubular;

a portable controller connected to the portable induction cleaning apparatus with computer readable media containing instructions to instruct a portable processor on operation given commands from at least one of an administrative processor with administrative computer readable media with instructions for instructing the administrative processor to control operations of the portable induction cleaning system, and a remote client device with a remote processor and remote computer readable media with instructions for instructing the remote processor to control operations of the portable induction cleaning system, wherein the remote client device, administrative processor and portable controller all communicate via a global communication network;

d. a hose assembly connected with the portable resonance induction cleaning apparatus, wherein the hose assembly is configured to receive the pressurized pulses of the liquid from the portable resonance induction cleaning apparatus, and wherein the hose assembly is configured to engage the process tubular for providing the pressurized pulses of the liquid thereto;

e. a first pressure regulator for regulating the pressure of the liquid flowing from the portable high pressure plunger pump, the first pressure regulator connected to the portable processor;

f. a second pressure regulator for regulating the pressure of the liquid flowing to the hose assembly, the second pressure regulator connected to the portable processor;

g. an air conduit connected with the portable resonance induction cleaning apparatus for receiving air from an air source in communication with the portable processor, wherein flow of the pressurized pulses of the liquid from the portable resonance induction cleaning apparatus to the hose assembly is additionally controlled via the air; wherein the portable resonance induction cleaning apparatus comprises: (i) an air pressure manifold configured to receive the air through the air conduit from the air source; (ii) a regulator valve for regulating a pressure of the air and providing the air to one or more pneumatic control valves of the portable resonance induction cleaning apparatus; (iii) a first water control valve configured to be actuated via the air from the one or more pneumatic control valves forming a pneumatic control valve and water control valve combination wherein the first water control valve is configured to receive the liquid from the portable high pressure plunger; (iv) a second water control valve configured to be actuated via the air from the one or more pneumatic control valves forming a pneumatic control valve and water control valve combination, wherein the second water control valve is configured to receive the liquid from the portable high pressure plunger pump, wherein when the first water control valve is opened the liquid flows through the first water control valve to the second water control valve, and wherein when the second water control valve is opened the pressurized pulses of the liquid flow to the hose assembly; wherein the second pressure regulator is in fluid communication between the second water control valve and the hose assembly and the control valves control different frequencies of resonance; wherein the pressurized pulses of the liquid are continually provided and expelled into the process tubular through the hose assembly until a standing column of the liquid is formed in the process tubular; and wherein the standing column of liquid receives the resonance from the pressurized pulses of the liquid and transmits the resonance through the process tubular for removing fouling from the process tubular, and further wherein expulsion of the pressurized pulses of the liquid from the portable resonance induction cleaning apparatus to the hose assembly is controlled via the air.

2. The remote controlled portable resonance induction cleaning system of claim 1, further comprising a power supply in communication with the portable high pressure plunger pump.

3. The remote controlled portable resonance induction cleaning system of claim 1, further comprising a first high pressure liquid hose connecting the portable resonance induction cleaning apparatus with the portable high pressure plunger pump, wherein the hose assembly comprises a second high pressure liquid hose connected to the portable resonance induction cleaning apparatus and a hose connector connected to the second high pressure liquid hose.

4. The remote controlled portable resonance induction cleaning system of claim 3, wherein the first high pressure liquid hose and the second high pressure liquid hose each have a length ranging from 25 feet to 500 feet and are each at a pressure ranging from 100 psi to 10,000 psi.

5. The remote controlled portable resonance induction cleaning system of claim 3, wherein the hose connector is a blind flange hose connection.

6. The remote controlled portable resonance induction cleaning system of claim 1, wherein the air source is at a pressure ranging from 80 psi to 110 psi.

7. The remote controlled portable resonance induction cleaning system of claim 1, further comprising a holding tank disposed on the movable support and in fluid communication between the liquid supply and the portable high pressure plunger pump.

8. The remote controlled portable resonance induction cleaning system of claim 1, wherein the movable support is a skid, a trailer, a barge, a floating platform, a truck, a boat, or a rail car.

9. The remote controlled portable resonance induction cleaning system of claim 1 further comprising at least one particulate filter in fluid communication between the liquid supply and the portable high pressure plunger pump.

10. The remote controlled portable resonance induction cleaning system of claim 1, wherein the first pressure regulator is in fluid communication between the portable high pressure plunger pump and the portable resonance induction cleaning apparatus.

11. The remote controlled portable resonance induction cleaning system of claim 1, wherein the portable resonance induction cleaning apparatus further comprises: a third water control valve configured to be dosed via the air for stopping flow of the pressurized pulses of the liquid, and wherein the third water control valve is in fluid communication between the first water control valve and the second water control valve.

12. The remote controlled portable resonance induction cleaning system of claim 1, wherein when the first water control valve is closed the liquid flows to the portable high pressure plunger pump.

13. The remote controlled portable resonance induction cleaning system of claim 1, wherein the portable resonance induction cleaning apparatus comprises an enclosure configured to contain an over-pressurization rupture in the portable resonance induction cleaning apparatus.

14. The remote controlled portable resonance induction cleaning system of claim 13, wherein the enclosure comprises one or more handles and one or more lifting eyes.

15. The remote controlled portable resonance induction cleaning system of claim 1, wherein the process tubular is a substantially fouled process tubular.

* * * * *